US005655928A

United States Patent [19]

Akeda

[11] Patent Number: 5,655,928

[45] Date of Patent: Aug. 12, 1997

[54] INCOMPLETE ENGAGEMENT DETECTING STRUCTURE IN A CONNECTOR

[75] Inventor: Nobuyuki Akeda, Shizuoka, Japan

[73] Assignee: Yazaki Corporation, Tokyo, Japan

[21] Appl. No.: 536,500

[22] Filed: Sep. 28, 1995

[30] Foreign Application Priority Data

Oct. 19, 1994 [JP] Japan ..... 6-253698

[51] Int. Cl.[6] ..... H01R 3/00

[52] U.S. Cl. ..... 439/489; 439/533

[58] Field of Search ..... 439/357, 488, 439/489, 527, 533

[56] References Cited

U.S. PATENT DOCUMENTS

| | | | |
|---|---|---|---|
| 4,906,204 | 3/1990 | Metzger | 439/533 X |
| 5,048,161 | 9/1991 | Watanabe et al. | 24/704.1 |
| 5,393,248 | 2/1995 | Yagi et al. | 439/595 |

FOREIGN PATENT DOCUMENTS

| | | | |
|---|---|---|---|
| 1-130281 | 9/1989 | Japan | H01R 13/639 |
| 1-130280 | 9/1989 | Japan | H01R 13/639 |
| 4-27588 | 3/1992 | Japan | H01R 31/08 |

*Primary Examiner*—Khiem Nguyen
*Attorney, Agent, or Firm*—Sughrue, Mion, Zinn, Macpeak & Seas

[57] ABSTRACT

In a connector, an incomplete insertion detecting structure is formed as follows: A flexible locking piece adapted to engage with a terminal is formed in each terminal accommodating chamber. A rib insertion space, into which the flexible locking piece is retracted when bent as the terminal is inserted into the terminal accommodating chamber, is formed adjacent to the terminal accommodating chambers. A rib, which is inserted into the rib insertion space, is extended from an engaging body. A flexible arm is provided in the rib insertion space so as to engage with the rib thus inserted. A bracket insertion space is formed adjacent to the rib insertion space into which a through-bracket is inserted and into which the flexible arm is retracted while being bent as the rib is inserted into the rib insertion space. Thus, the incomplete insertion detecting structure is able to positively detect the incomplete engagement of the terminals, bus bars and/or housings.

13 Claims, 9 Drawing Sheets

INCOMPLETE ENGAGEMENT DETECTING STRUCTURE IN A CONNECTOR

BACKGROUND OF THE INVENTION

1. Field of the Invention

This invention relates to a connector of the type that housings are engaged with each other, or bus bars are fitted in a housing to electrically connect terminals, and more particularly to a structure which detects the incomplete engagement of terminals, bus bars and/or housings in the connector.

2. Discussion of the Related Art

Two kinds of connectors of this type are known in the art. One of the connectors is such that housings are engaged with each other so that terminals mounted in those housings are electrically connected to one another. The other is a so-called "joint connector" which is so designed that bus bars are fitted in a housing so that selected terminals are electrically connected to one another.

The joint connector will be described as a typical example of the conventional connectors with reference to FIG. 10 which has been disclosed by Japanese Utility Model Unexamined Publication No. Hei. 4-27588.

In FIG. 10, reference numeral 1 designates the joint connector which comprises: a housing 3; and an engaging body, namely, a plug body 11. The housing 3 has a plurality of terminal accommodating chambers (not shown) formed juxtaposed therein. The terminal accommodating chambers are opened both in the front and in the rear of the housing 3. A terminal 7, which is pressure-connected to an electrical wire 5, is inserted into each of the terminal accommodating chambers from behind, where the terminal 7 is locked by a flexible locking piece (not shown) provided in the terminal accommodating chamber, so that the terminal 7 is prevented from coming off the housing 3.

The housing 3 has a plug body accommodating chamber 9 in the front which is communicated with the terminal accommodating chambers. The aforementioned plug body 11 is engaged with the plug body accommodating chamber 9. The plug body 11 has a plurality of bus bars 13 which are inserted into the respective terminal accommodating chambers.

In the joint connector 1 thus constructed, the terminals 7 are inserted into the terminal accommodating chambers, and then the plug body 11 is engaged with the plug body accommodating chamber 9, so that the desired terminals are electrically connected to one another through the bus bars 13 of the plug body 11.

As was described above, in the conventional joint connector 1, the terminals 7 are inserted into the terminal accommodating chambers of the housing 3, and then the plug body 11 is engaged with the plug body accommodating chamber 9, so that the desired terminals are electrically connected to one another. Hence, in the case where the terminals 7 are incompletely inserted into the terminal accommodating chambers, or the plug body 11 is incompletely engaged with the plug body accommodating chamber 9, the bus bars 13 may not be brought into contact with the terminals 7 at predetermined positions; that is, the desired terminals may not be electrically connected to one another. In order to eliminate this difficulty, heretofore it is detected visually or by using a checker jig or the like whether or not the terminals 7 are completely inserted into the housing 3, or whether or not the plug body 11 is completely engaged with the housing 3.

However, the visual detection is disadvantageous in the following points: That is, it is difficult for the visual detection to positively decide the incomplete engagement of the terminals, bus bars and/or housings. Particularly, the visual detection of the incomplete insertion of the terminals 7 into the terminal accommodating chambers is liable to fail with high probability. The detection with the checker jig is also disadvantageous in that the equipment cost is increased, and the detection is rather troublesome, so that the installation of the connector is low in workability.

The same may be said about an ordinary connector of the type that its housings are engaged with each other to electrically connect the terminals to one another.

SUMMARY OF THE INVENTION

In view of the foregoing, an object of the invention is to provide an incomplete engagement detecting structure which is able to detect the incomplete engagement of the terminals, bus bars, and/or housings in a connector without use of the checker jig, thereby to improve the reliability in engagement of the connector.

In order to attain the above object, the invention provides an incomplete engagement detecting structure in a connector comprising: an engaging body having a rib protruded therefrom; and a housing which is to be engaged with the engaging body, the housing comprising a flexible arm which is provided in a rib insertion space into which the rib is inserted and which is to be engaged with the rib, wherein a bracket insertion space into which a through-bracket is inserted is formed adjacent to the rib insertion space, the bracket insertion space serving as a space into which the flexible arm is retracted being bent as the rib is inserted into the rib insertion space.

DETAILED DESCRIPTION OF THE PREFERRED EMBODIMENTS

The invention will be described with reference to its preferred embodiments shown in the accompanying drawings.

First Embodiment

Figure 1:
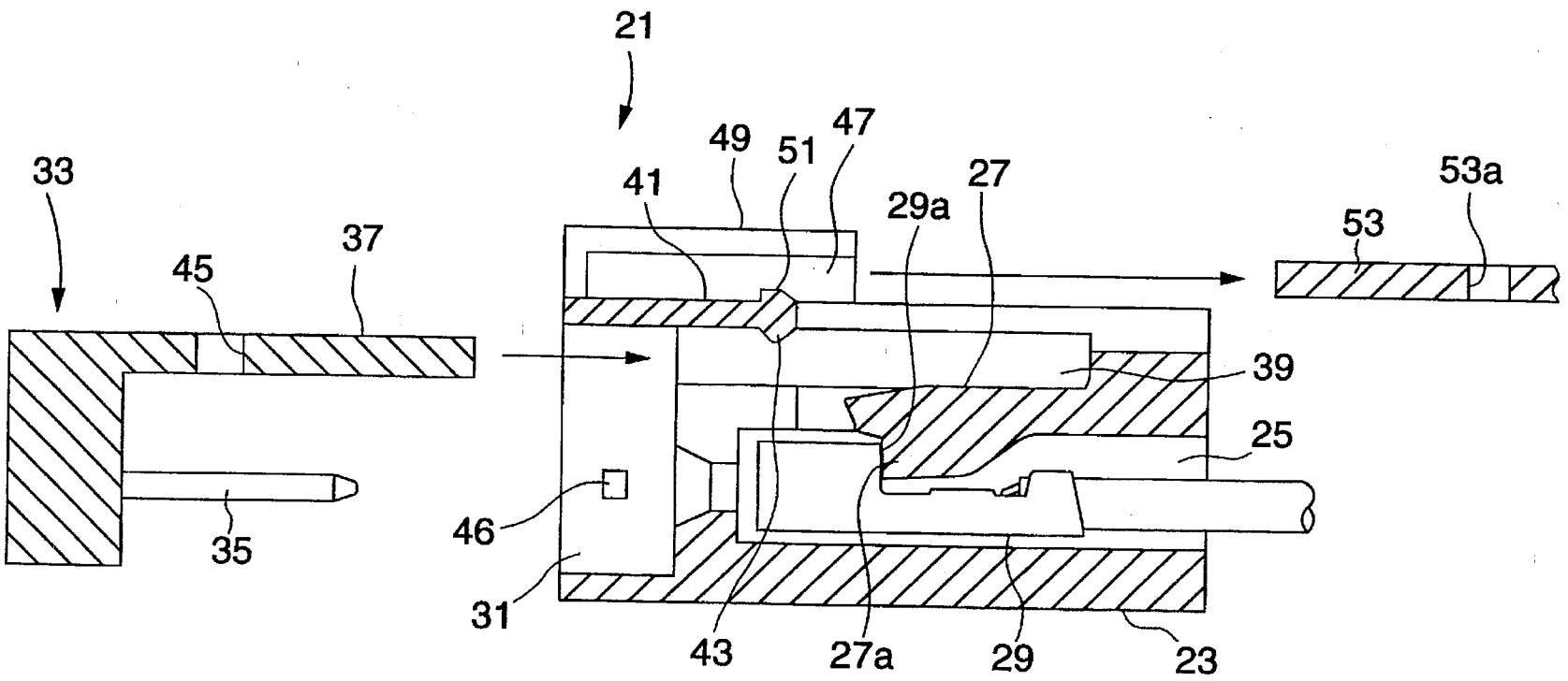
FIG. 1 is a sectional view showing an example of an incomplete engagement detecting structure in a joint connector, which constitutes a first embodiment of the invention.
Figure 2:
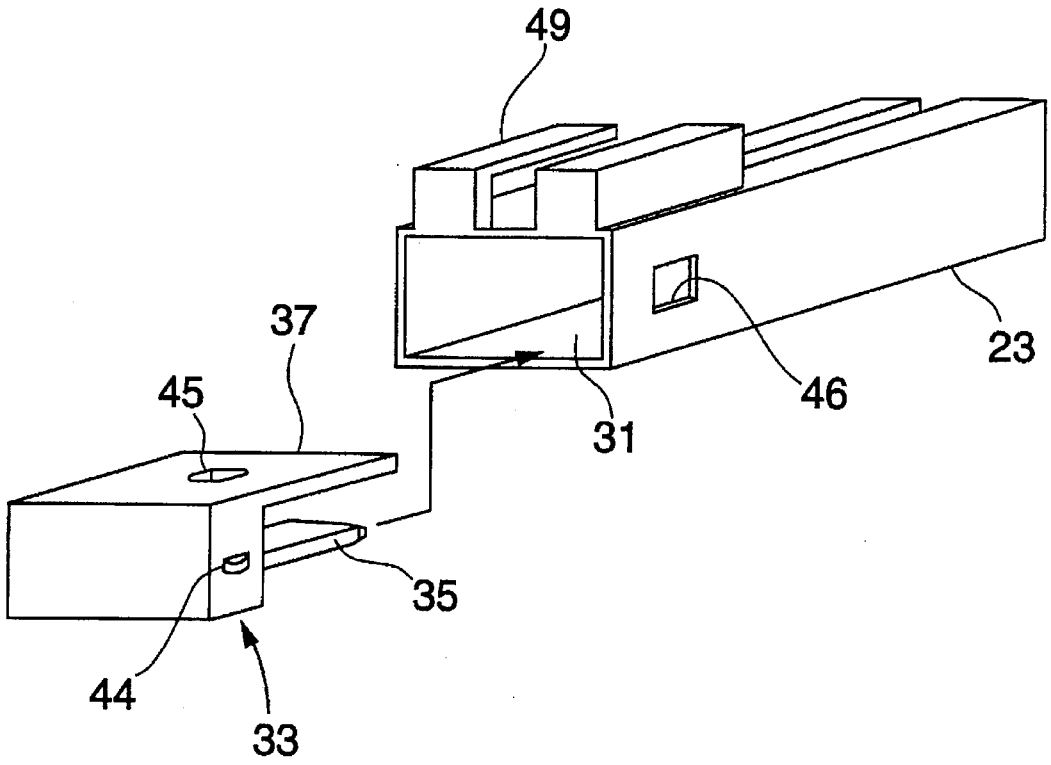
FIG. 2 is a perspective view showing a front spacer and a housing in the joint connector, which are to be engaged with each other.
Figure 3:
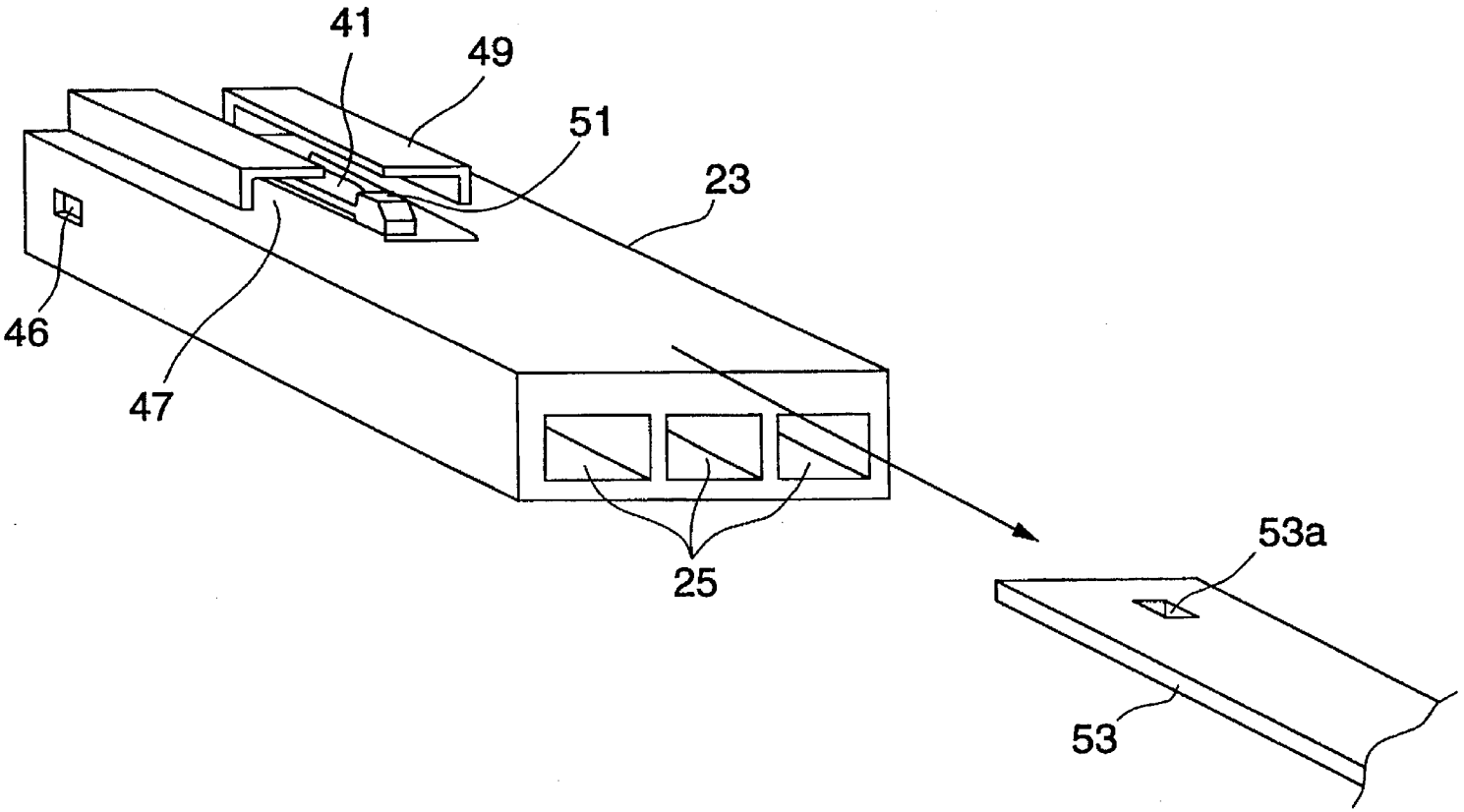
FIG. 3 is a perspective view showing the housing and a bracket in the joint connector, which are to be engaged with each other.

FIGS. 1 through 3 show an example of an incomplete engagement detecting structure in a joint connector, which constitutes a first embodiment of the invention.

As shown in those figures, a joint connector 21, which is made from synthetic resin, comprises a housing 23 having terminal accommodating chambers 25 which are each opened both in the front and in the rear of the housing 23. In each of the terminal accommodating chambers 25, a flexible locking piece 27 is formed in such a manner that it is extended in the front-to-rear direction of the housing 23. Each flexible locking piece 27 is flexible as the name implies, with its base end portion integral with the rear end portion of the housing 23. The front end portion of the flexible locking piece 27 is formed into a locking protrusion 27*a* which is protruded into the terminal accommodating chamber 25. The locking protrusion 27*a* of the flexible locking piece 27 is locked to the rear locking end face 29*a* of a terminal 29 when the latter 29 is inserted into the terminal accommodating chamber 25 to a predetermined position.

The housing 23 has a spacer accommodating chamber 31 in the front which is communicated with the terminal accommodating chambers 25. An engaging body, namely, a front spacer 33 is provided to be engaged with the spacer accommodating chamber 31. The spacer 33 has a plurality of bus bars 35 which are inserted into the respective terminal accommodating chambers. In addition, the front spacer 33 includes a plate-shaped rib 37 which is extended in the same direction as the bus bars 35. The rib 37 is inserted into a rib insertion space 39 which is formed adjacent to the terminal accommodating chambers 25 in the housing 23. The rib insertion space 39 serves also as a space into which the flexible locking piece 27 is retracted when bent as the terminal 29 is inserted into the terminal accommodating chamber 25.

A flexible arm 41 is formed in the upper wall of the housing 23 which is confronted through the rib insertion space 39 with the flexible locking pieces, in such a manner that the arm 41 is extended in the front-to-rear direction of the housing 23. The flexible arm 41 is flexible as the name implies. More specifically, the arm 41 is cantilevered with its base end portion being integral with the front end portion of the housing 23. The flexible arm 41 has an incomplete engagement detecting protrusion 43 on one side of its free end portion which is protruded into the rib insertion space 39 of the housing 23. The incomplete engagement detecting protrusion 43 is so designed that, when the rib 37 is inserted into the rib insertion space 39 to a predetermined position, the protrusion 43 is engaged with a locking hole 45 formed in the rib 37.

The front spacer 33 is locked when a locking protrusion 44 (FIG. 2) formed on one side wall of the front spacer 33 is engaged with a locking hole 46 formed in the housing 23.

The housing 23 has a bracket insertion member 49 on the upper wall which defines a bracket insertion space 47. More specifically, the bracket insertion member 49 has an opening in the rear, which is used as a bracket inserting inlet. The bracket insertion space 47, being adjacent to the flexible arm 41, serves as a space into which the arm 41 is retracted when bent. The flexible arm 41 further includes a bracket protrusion 51 on the other side of the free end portion, which is opposite to the side where the incomplete engagement detecting protrusion 43 is provided, in such a manner that the bracket protrusion 51 is protruded into the bracket insertion space 47, and is engaged with a locking section 53*a* like a through-hole formed in a through-bracket 53 (FIG. 3).

The function of the incomplete engagement detecting structure thus formed will be described with reference to FIGS. 4 and 5.

Figure 4:
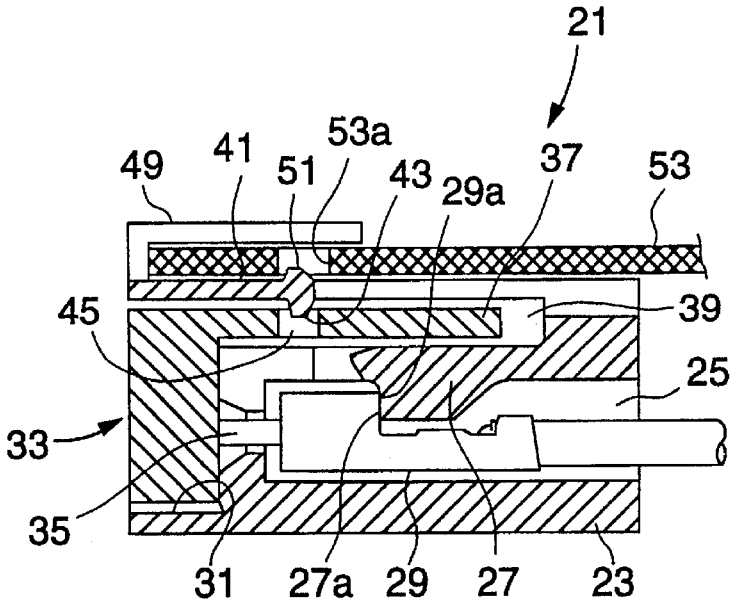
FIG. 4 is a sectional view showing a terminal and the front spacer in the joint connector which are completely engaged with the housing.

FIG. 4 shows the joint connector 21 in which the front spacer 33 is completely engaged with the spacer accommodating chamber 31.

When the terminal 29 is inserted into the terminal accommodating chamber 25, the flexible locking piece 27 is bent, and retracted into the rib insertion space 39. When the terminal 29 is inserted to the predetermined position, the rear locking end face 29*a* of the terminal 29 is aligned with the locking protrusion 27*a* of the flexible locking piece 27, as a result of which the latter 27 is elastically restored; that is, the flexible locking piece 27 is caused to come out of the rib insertion space 39, thus being engaged with the terminal 29. Consequently, the terminal 29 is fixed to the housing 23 through the flexible locking piece 27.

As the front spacer 33 is inserted into the spacer accommodating chamber 31, the bus bars 35 are inserted into the respective terminal accommodating chambers 25, so that the predetermined terminals 29 are electrically connected to one another through the bus bars 35. At the same time, the rib 37 of the front spacer 33 is inserted into the rib insertion space 39. Upon insertion of the rib 37 into the space 39, the flexible arm 41 is bent, and retracted into the bracket insertion space 47. When the rib 37 is inserted into the space 39 to a predetermined position, the locking hole 45 of the rib 37 reaches the incomplete engagement detecting protrusion 43, as a result of which the flexible arm 41 is elastically restored; that is, the arm 41 is caused to come out of the bracket insertion space 47, thus being engaged with the rib 37. At the same time, the locking protrusion 44 of the front spacer 33 is engaged with the locking hole 46 of the housing 23, so that the front spacer 33 is fixedly engaged with the housing 23.

After the front spacer 33 is fixedly engaged with the housing 23 in the above-described manner, the through-bracket 53 is inserted into the bracket insertion space 47 of the housing 23, so that the connector is mounted, for instance, on the vehicle body. Upon insertion of the through-bracket 53 into the bracket insertion space 47, the flexible arm 41 is somewhat bent towards the rib insertion space 39, and the bracket insertion member 49 is slightly expanded. When, under this condition, the through-bracket 53 is inserted to a predetermined position, the locking section 53*a* of the through-bracket 53 reaches the bracket protrusion 51 of the flexible arm 41, so that the bracket protrusion 51 is engaged with the locking section 53*a*. Thus, the joint connector 21 has been fixedly coupled to the through-bracket 53.

Now, the detection of the incomplete engagement of the terminal 29, and that of the incomplete engagement of the front spacer 33 will be described.

Figure 5:
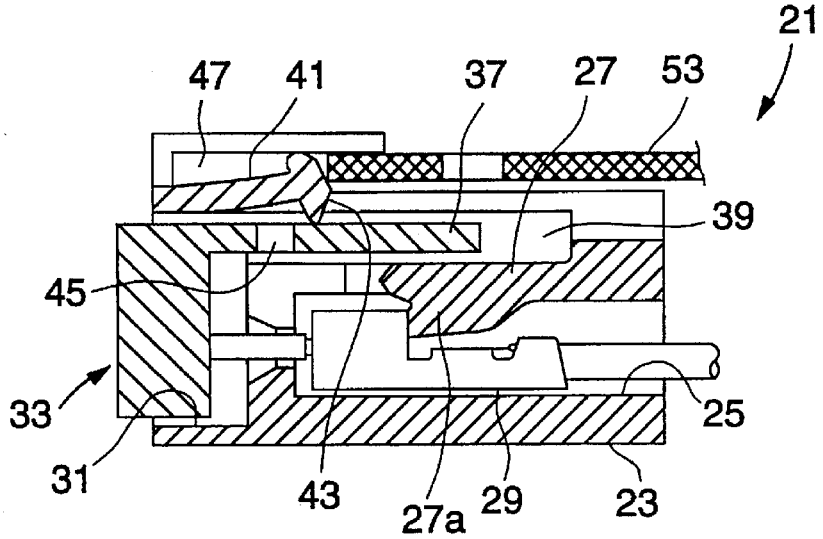
FIG. 5 is a sectional view showing the terminal which is completely engaged with the housing, and the front spacer which is incompletely engaged with the housing.

FIG. 5 shows the joint connector 21 in which the front spacer 33 is incompletely inserted into the spacer accommodating chamber 31 of the housing 23.

In the case (not shown) where the terminal 29 is incompletely inserted into the terminal accommodating chamber 25, the locking protrusion 27*a* of the flexible locking piece 27 retracted into the rib insertion space 39 upon insertion of the terminal 29 is not aligned with the rear locking end face 29*a* of the terminal 29; that is, the flexible locking piece 27 is maintained retracted in the rib insertion space 39. Hence, when inserted into the spacer accommodating chamber 31, the front spacer 33 is blocked by the flexible locking piece 27 thus retracted; that is, the front space 33 cannot be inserted into the chamber 31 to the predetermined position, which indicates that the terminal is incompletely inserted into the terminal accommodating chamber. Thus, the incomplete insertion of the terminal has been detected.

On the other hand, there may be a case in which, as shown in FIG. 5, the front spacer 33 is incompletely engaged with the spacer accommodating chamber 31 of the housing 23 although the terminal 29 is completely engaged with the terminal accommodating chamber 25. In this case, the incomplete engagement detecting protrusion 43 of the flexible arm 41 which has been retracted into the bracket insertion space 47 upon insertion of the rib 37 is not aligned with the locking hole 45 of the rib 37; that is, the flexible arm 41 is held retracted in the bracket insertion space 47. Hence, when inserted into the bracket insertion space 47, the through-bracket 53 is blocked by the flexible arm 41 thus retracted; that is, the through-bracket 53 cannot be inserted into the bracket insertion space 47 to the predetermined position, which indicates that the front spacer 33 is incompletely inserted into the spacer accommodating chamber 31. Thus, the incomplete engagement of the front spacer 33 with the spacer accommodating chamber 31 of the housing 23 has been detected.

With the above-described joint connector 21, the incomplete engagement of the terminal 29 is detected from the fact that the front spacer 33 cannot be inserted into the spacer accommodating chamber 31 to the predetermined position, and the incomplete engagement of the front spacer 33 is detected from the fact the through-bracket 53 cannot be inserted into the bracket insertion space 47 to the predetermined position. That is, the incomplete engagement can be positively detected without use of a checker jig. If summarized, the incomplete engagement of the terminal or the front spacer can be detected readily at low cost.

Second Embodiment

Figure 6:
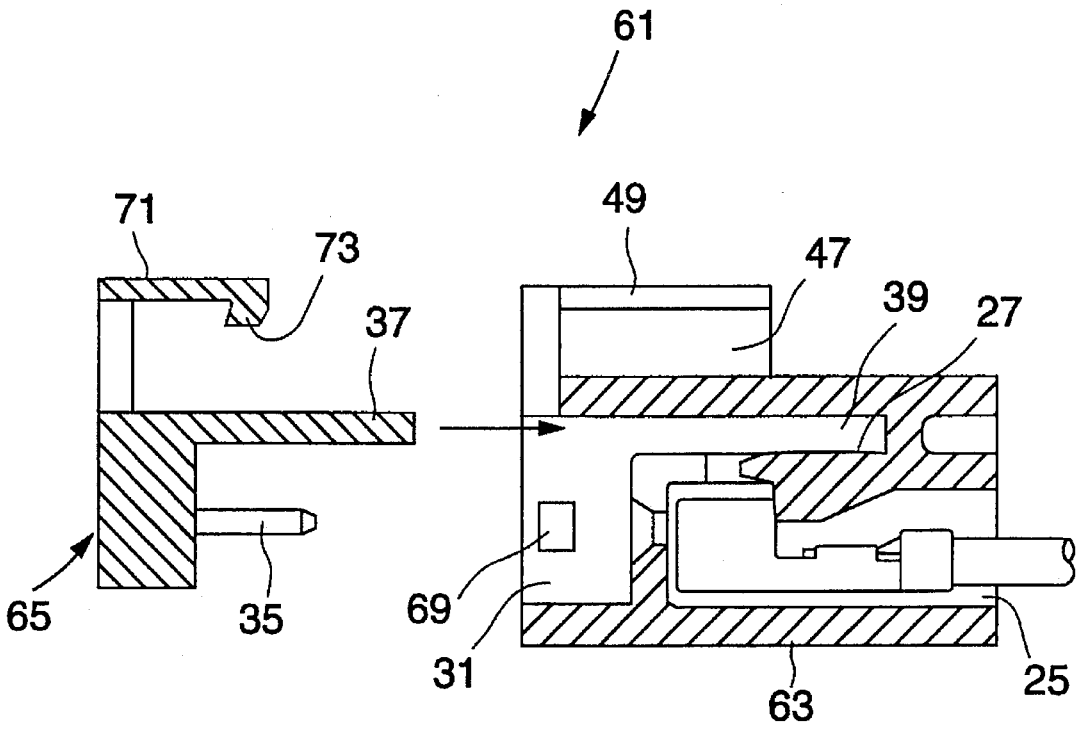
FIG. 6 is a sectional view showing another example of the incomplete engagement detecting structure, which constitutes a second embodiment of the invention.
Figure 7:
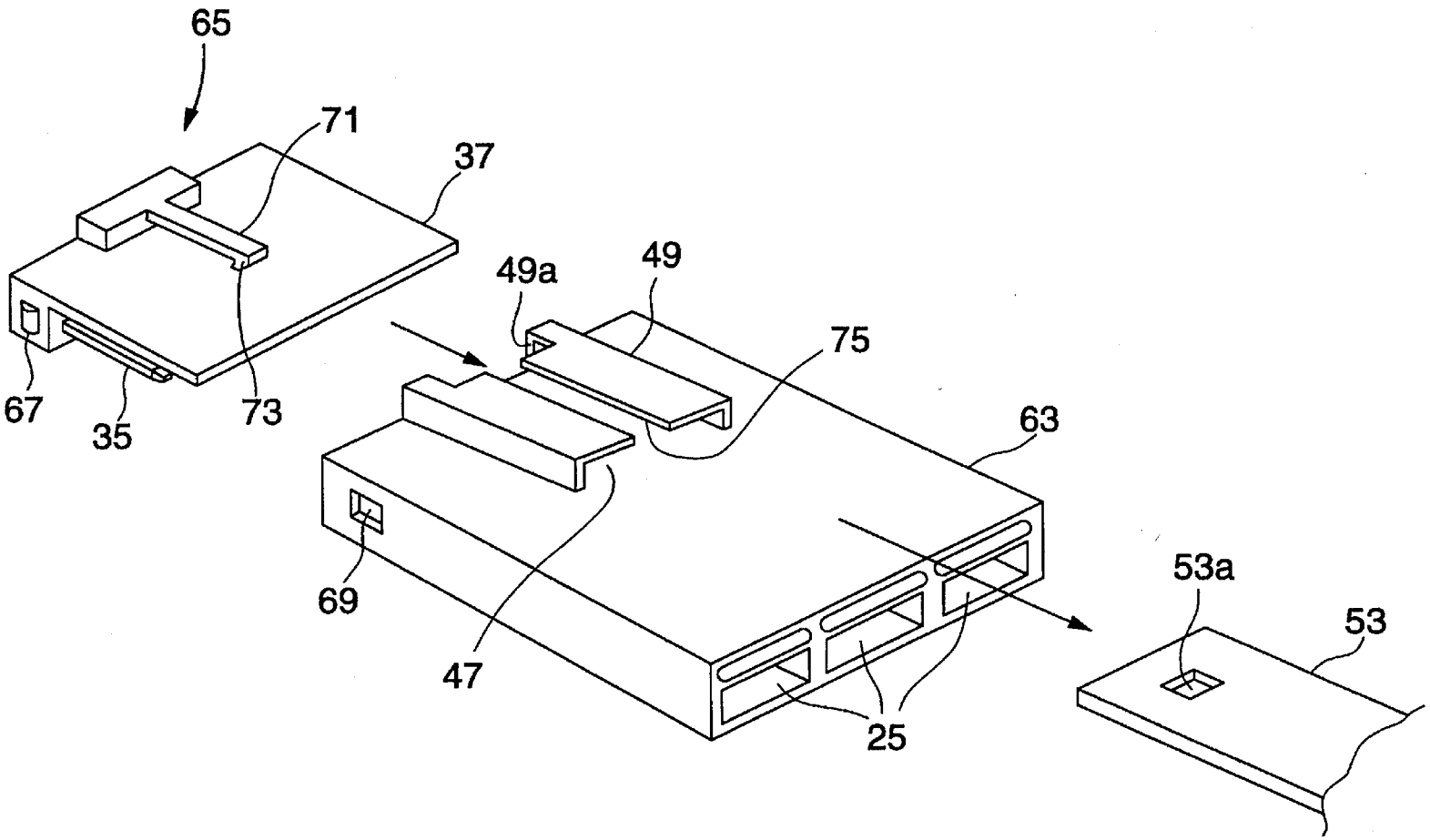
FIG. 7 is a perspective showing a front spacer, a housing and a through-bracket in the second embodiment, which are to be engaged with each other.

Now, another example of the incomplete engagement detecting structure, which constitutes a second embodiment of the invention, will be described with reference to FIGS. 6 and 7, in which parts corresponding functionally to those already described with reference to FIGS. 1 through 5 are therefore designated by the same reference numerals or characters.

In the second embodiment, a joint connector 61 includes: a housing 63 which has terminal accommodating chambers 25, flexible locking pieces 27, a spacer accommodating chamber 31, a rib insertion space 39, and a bracket insertion member 49 which are substantially equal to those in the above-described joint connector 21; and a front spacer 65 having bus bars 35 and a rib 37 which are substantially equal to those in the above-described joint connector 21.

However, it should be noted that, in the second embodiment, the bracket insertion member 49 has its front end face 49*a* closed which corresponds to the front end face of the housing 63, preventing the insertion of the bracket 53 beyond the predetermined position.

In addition, in the second embodiment, unlike the first embodiment, no flexible arm 41 is employed. The front spacer 65 is fixed by engaging a locking protrusion 67 (FIG. 7) formed on the side wall of the front spacer 65 with a locking hole 69 formed in the housing 63.

A locking lever 71 is formed on the upper wall of the front spacer 65 in such a manner that the lever 71 is extended in the same direction (front-to-rear direction) as the rib 37. The locking lever 71 has a locking pawl 73 at the end. The bracket insertion member 49 has an elongated cut 75 formed in the upper wall, which is extended in the front-to-rear direction of the housing 63 as shown in FIG. 7. The cut 75 is to receive the locking lever 71 as the front spacer 65 is inserted into the housing 63. That is, the locking lever 71, when led into the cut 75, protrudes the locking pawl 73 into the bracket insertion space 47, to engage with the locking section 53*a* formed in the through-bracket 53.

The function of the incomplete engagement detecting structure thus formed in the joint connector 61 will be described with reference to FIGS. 8 and 9.

Figure 8:
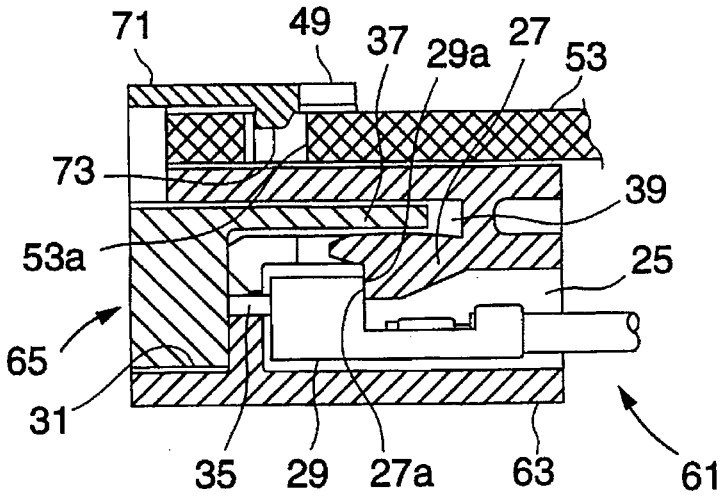
FIG. 8 is a sectional view showing the terminal and the front spacer which are completely engaged with the housing.

FIG. 8 shows the joint connector 61 in which the front spacer and the terminals are completely engaged with the housing.

As the terminal 29 is inserted into the terminal accommodating chamber 29, the flexible locking piece 27 is bent, and retracted into the rib insertion space 39. When the terminal 29 is inserted into the chamber 25 to the predetermined position, the rear locking end face 29*a* of the terminal 29 is aligned with the locking protrusion 27*a* of the flexible locking piece 27, so that the latter 27 is elastically restored; that is, the flexible locking piece 27 is caused to come out of the space 39, and engage with the terminal 29. Thus, the terminal 29 is engaged with the housing 63 with the aid of the flexible locking piece 27.

Next, the front spacer 65 is inserted into the spacer accommodating chamber 31. In this operation, the bus bars 35 are inserted into the respective terminal accommodating chambers 25, so that the predetermined terminals are electrically connected to one another through the bus bars 35. At the same time, the rib 37 of the front spacer 65 is inserted into the rib insertion space 39. When the rib 37 is inserted into the space 39 to the predetermined position, the locking protrusion 67 (FIG. 7) of the front spacer 65 is engaged with the locking hole 69 of the housing 63, so that the front spacer 65 is fixedly engaged with the housing 63.

The housing 63, with which the front spacer 65 has been engaged, is mounted on a given object by inserting the through-bracket 53 into the bracket insertion space 47. As the through-bracket 53 is inserted into the bracket insertion space 47, the locking pawl 73 of the locking lever 71 which is led into the bracket insertion space 47 through the elongated cut 75 is engaged with the locking section 53*a* of the through-bracket 53, so that the joint connector 61 is coupled to the through-bracket 53.

Now, the detection of the incomplete engagement of the terminal 29 and that of the incomplete engagement of the front spacer 65 will be described.

Figure 9:
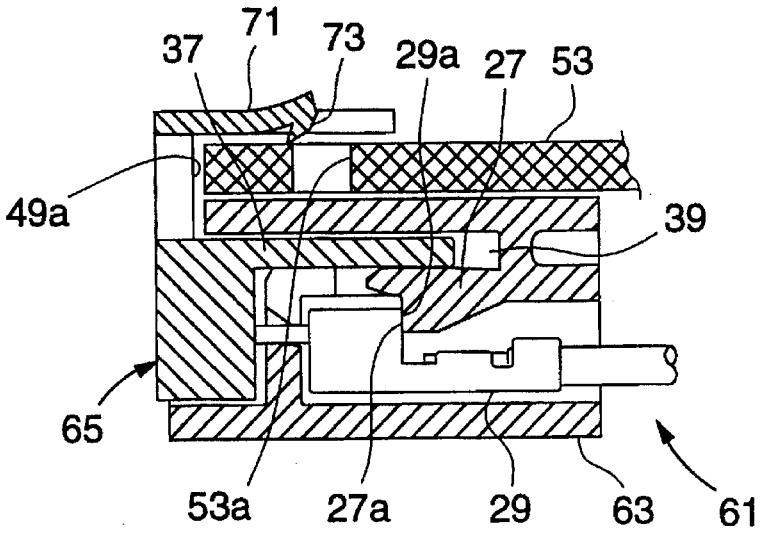
FIG. 9 is a sectional view showing the incomplete engagement of the front spacer in the second embodiment.
Figure 10:
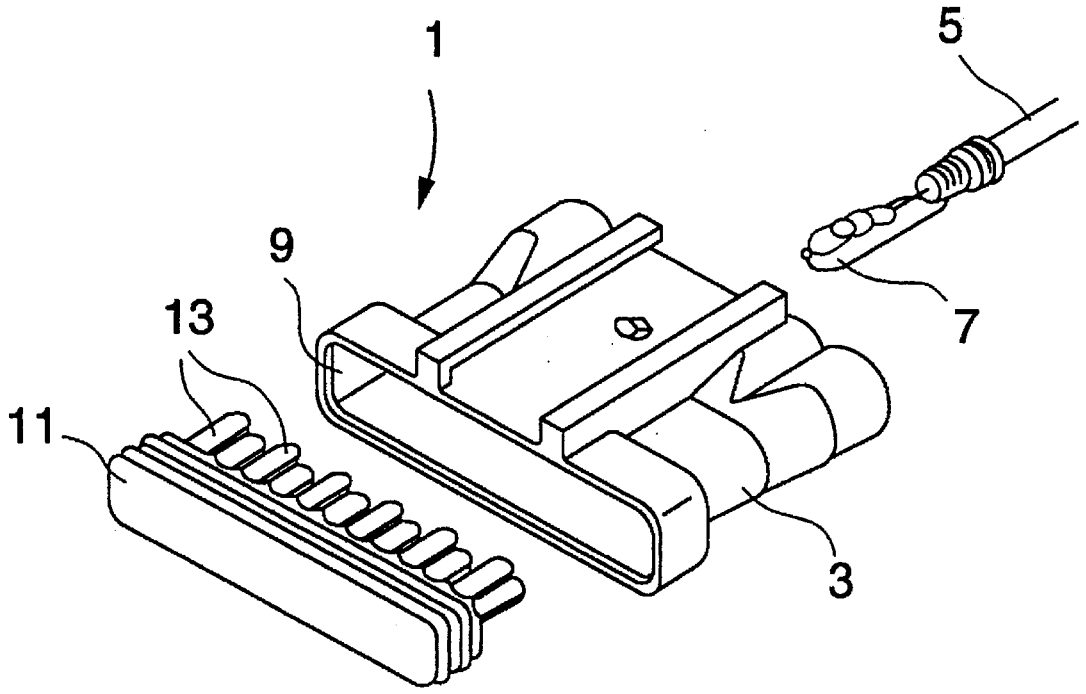
FIG. 10 PRIOR ART
FIG. 10 is a perspective view showing a conventional joint connector.

FIG. 9 shows the joint connector 21 in which the front spacer 65 is incompletely engaged with the housing 63.

In the case (not shown) where the terminal 29 is incompletely inserted into the terminal accommodating chamber 25, the locking protrusion 27*a* of the flexible locking piece 27 retracted in the rib insertion space 39 when the terminal 29 is inserted into the chamber 25 is not aligned with the rear locking end face 29*a* of the terminal 29, and therefore the flexible locking piece 27 is held retracted in the space 39. Hence, when inserted into the spacer accommodating chamber 31, the front spacer 65 is blocked by the flexible locking piece 27 thus held retracted, which indicates the incomplete insertion of the terminal 29. That is, the incomplete engagement of the terminal 29 has been detected.

On the other hand, there may be a case in which, as shown in FIG. 9, the front spacer 65 is incompletely engaged with the housing 63 although the terminal 29 is completely engaged with the terminal accommodating chamber 25. In this case, the locking lever 71 is not inserted to the predetermined position, and accordingly the locking pawl 73 is located before the predetermined position. Hence, even when the through-bracket 53 is fully inserted into the bracket insertion space 47 until its front end abuts against the end face 49*a* of the bracket insertion member 49, the locking section 53*a* is not aligned with the locking pawl 73; that is, the through-bracket 53 is not locked by the locking lever, which indicates the incomplete insertion of the front spacer 65. Thus, the incomplete engagement of the front spacer 65 has been detected.

With the above-described joint connector 61, during installation, the incomplete engagement of the terminal 29 is detected from the fact that the front spacer 65 cannot be inserted into the spacer accommodating chamber 31 to the predetermined position, and the incomplete engagement of the front spacer 65 is detected from the fact the through-bracket 53 cannot be locked. Hence, similarly as in the case of the above-described first embodiment, the incomplete engagement can be positively detected. In addition, the detection requires no checker jig. If summarized, the incomplete engagement of the terminal and/or the front spacer can be detected readily at low cost.

While the invention has been described with reference to the joint terminal in which the bus bars are inserted into the housing to electrically connect the terminals to one another, the technical concept of the invention can be applied to an ordinary connector in which the housings are engaged with each other to electrically connect the terminals to one another. In this case, one of the housings is so designed that it has the same structure as the above-described housing 23 or 63, and the other housing is so designed that it has the above-described rib 37 of the first embodiment, or the above-described rib 37 and locking lever 71 of the second embodiment.

In the above-described embodiments, both the incomplete engagement of the terminal and that of the front spacer are detected; however, the invention is not limited thereto or thereby. That is, the connector may be so designed that the incomplete engagement of the terminal only or the incomplete engagement of the front spacer only is detected. For instance, in the case where the connector is so designed that the incomplete engagement of the front spacer only is detected, the structure that allows the flexible locking piece to retract into the rib insertion space can be eliminated; that is, the flexible locking piece may be provided at a desired position. In the case of the second embodiment shown in FIGS. 6 through 9, the rib of the front spacer, and the rib insertion space in the housing can be eliminated.

Figure 11:
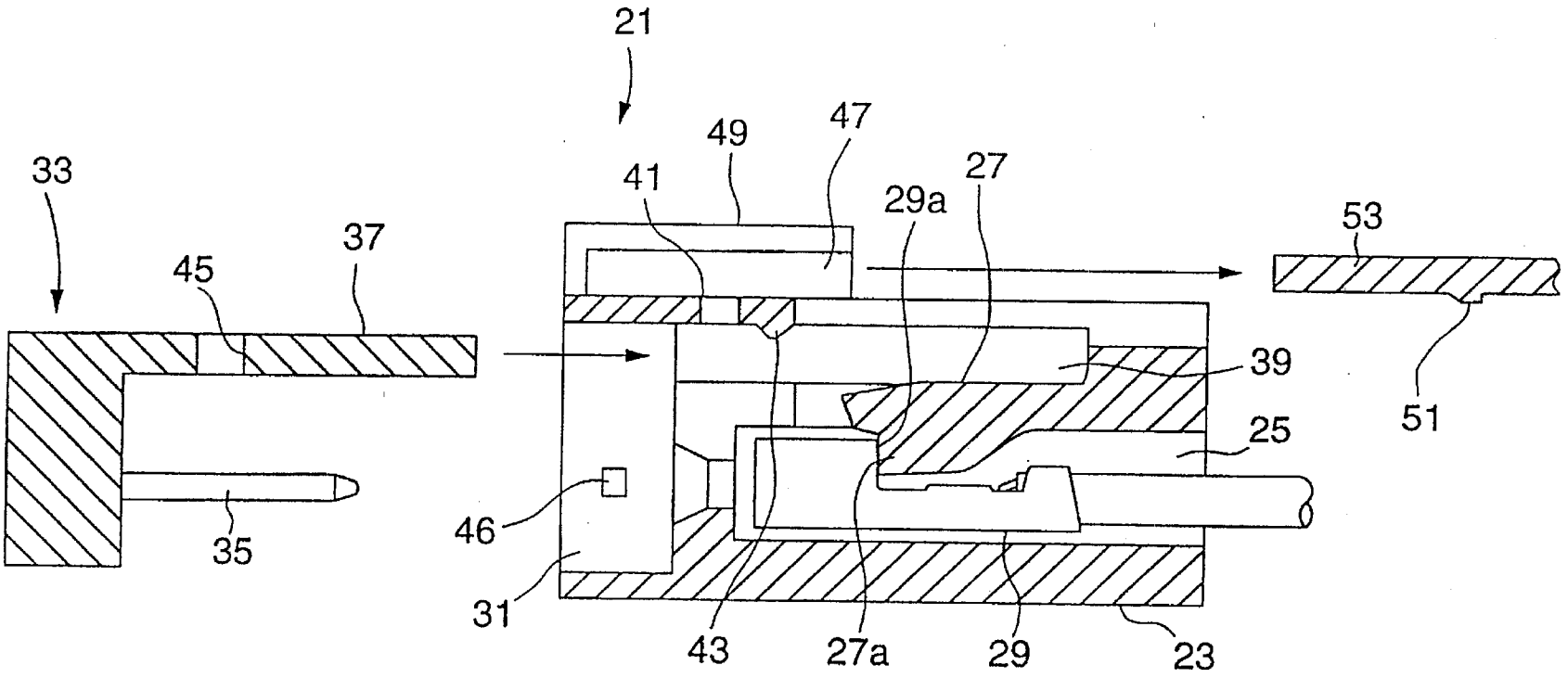
FIG. 11 is a sectional view of an incomplete engagement detecting structure according to yet another embodiment of the invention.

Furthermore, in the above-described first embodiment, the through-bracket has the hole-like locking section, and the flexible arm has the bracket protrusion which is to be engaged with the hole-like locking section; however, the invention is not limited thereto or thereby. That is, the connector may be so modified that the flexible arm 41 has the hole-like locking section 45, and the through-bracket 53 has the bracket protrusion 51, as shown in FIG. 11. In addition, instead of the hole-like locking section, a recess-like locking section may be employed.

As was described above, in the incomplete engagement detecting structure of the invention, the rib insertion space into which the flexible locking piece is retracted is provided adjacent to the terminal accommodating chamber, and the bracket insertion space into which the flexible arm is retracted is formed adjacent to the rib insertion space. Hence, during the installation of the connector, the incomplete engagement of the terminal is detected from the fact that the engaging body cannot be inserted to the predetermined position, and the incomplete engagement of the engaging body is detected from the fact the through-bracket cannot be inserted to the predetermined position. That is, the incomplete engagement can be positively detected without use of a checker jig. If summarized, the incomplete engagement of the terminal and/or the engaging body can be detected readily at low cost, improving the reliability of the connector according to the invention.

While there has been described in connection with the preferred embodiments of the invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. An incomplete engagement detecting structure in a connector comprising:

an engaging body having a rib protruded therefrom; and a housing which is to be engaged with said engaging body, said housing comprising a flexible arm which is at least partially provided in a rib insertion space into which the rib is inserted and which is to be engaged with the rib, wherein a bracket insertion space, into which a through-bracket is inserted, is formed adjacent to the rib insertion space, said bracket insertion space serving as a space into which said flexible arm is deflected when the rib is inserted into the rib insertion space, wherein said housing further comprises a flexible locking piece which is provided in a terminal accommodating chamber into which a terminal is inserted and which is to be engaged with the terminal, the rib insertion space serving as a space into which said flexible locking piece is deflected as the terminal is inserted into the terminal accommodating chamber.

2. The incomplete engagement detecting structure according to claim 1, wherein an end portion of said flexible locking piece is provided with a protrusion which locks the terminal when the terminal is inserted into the terminal accommodating chamber to a predetermined position.

3. An incomplete engagement detecting structure in a connector comprising:

an engaging body having a rib protruded therefrom; and a housing which is to be engaged with said engaging body, said housing comprising a flexible arm which is at least partially provided in a rib insertion space into which the rib is inserted and which is to be engaged with the rib, wherein a bracket insertion space, into which a through-bracket is inserted, is formed adjacent to the rib insertion space, said bracket insertion space serving as a space into which said flexible arm is deflected when the rib is inserted into the rib insertion space, wherein one side portion of an end of said flexible arm is provided with a protrusion which is engaged with a locking hole formed in the rib when the rib is inserted into the rib insertion space to a predetermined position.

4. The incomplete engagement detecting structure according to claim 3, wherein the other side portion of the end of said flexible arm is provided with a protrusion which is engaged with a hole-like locking section formed in the through-bracket when the through-bracket is inserted into the bracket insertion space to a predetermined position.

5. The incomplete engagement detecting structure according to claim 3, wherein the other side portion of the end of said flexible arm is provided with a hole-like locking section which is engaged with a protrusion formed on the through-bracket when the through-bracket is inserted into the bracket insertion space to a predetermined position.

6. An incomplete engagement detecting structure in a connector comprising:

an engaging body having a rib protruded therefrom; and a housing which is to be engaged with said engaging body, said housing comprising a flexible arm which is at least partially provided in a rib insertion space into which the rib is inserted and which is to be engaged with the rib, wherein a bracket insertion space, into which a through-bracket is inserted, is formed adjacent to the rib insertion space, said bracket insertion space serving as a space into which said flexible arm is deflected when the rib is inserted into the rib insertion space, wherein said engaging body is a front spacer having a plurality of bus bars.

7. An incomplete engagement detecting structure in a connector comprising:

an engaging body; and a housing which is to be engaged with said engaging body and which has a bracket insertion space formed therein into which a through-bracket is inserted, said engaging body comprising a locking lever which is led to the bracket insertion space and locked with a locking section of the through-bracket when said engaging body is completely engaged with said housing.

8. The incomplete engagement detecting structure according to claim 7, wherein a bracket insertion member constituting the bracket insertion space has a closed end face which limits the insertion of the through-bracket.

9. The incomplete engagement detecting structure according to claim 7, wherein said locking lever has a locking pawl which is to be engaged with the locking section of the through-bracket.

10. The incomplete engagement detecting structure according to claim 7, wherein said engaging body has a rib which is to be inserted into a rib insertion space of said housing.

11. The incomplete engagement detecting structure according to claim 10, wherein said housing further comprises a flexible locking piece which is provided in a terminal accommodating chamber into which a terminal is inserted and which is to be engaged with the terminal, the rib insertion space serving as a space into which said flexible locking piece is deflected as the terminal is inserted into the terminal accommodating chamber.

12. The incomplete engagement detecting structure according to claim 11, wherein an end portion of said flexible locking piece is provided with a protrusion which locks the terminal when the terminal is inserted into the terminal accommodating chamber to a predetermined position.

13. The incomplete engagement detecting structure according to claim 7, wherein said engaging body is a front spacer having a plurality of bus bars.

* * * * *